United States Patent [19]

Parry

[11] 4,355,219

[45] Oct. 19, 1982

[54] ELECTRICAL SWITCHGEAR

[75] Inventor: John Parry, Blackwood, Wales

[73] Assignee: South Wales Switchgear Limited, Blackwood, Wales

[21] Appl. No.: 151,580

[22] Filed: May 20, 1980

[30] Foreign Application Priority Data

May 25, 1979 [GB] United Kingdom ..... 7918466

[51] Int. Cl.[3] ..... H01H 33/18

[52] U.S. Cl. ..... 200/147 R; 200/148 R

[58] Field of Search ..... 200/147 R, 147 A, 144 B, 200/148 D, 148 G

[56] References Cited

U.S. PATENT DOCUMENTS

| | | | |
|---|---|---|---|
| 2,798,922 | 7/1957 | Lingal et al. | 200/148 G |
| 3,014,109 | 12/1961 | Burger | 200/147 A |
| 3,361,887 | 1/1968 | Bachofen | 200/144 B |
| 3,372,259 | 3/1968 | Porter | 200/144 B |
| 3,542,985 | 11/1970 | Madsen | 200/147 R |

FOREIGN PATENT DOCUMENTS

| | | | |
|---|---|---|---|
| 1640955 | 12/1970 | Fed. Rep. of Germany | 200/147 R |
| 719593 | 11/1931 | France | 200/147 R |
| 165961 | 12/1933 | Switzerland | 200/147 R |

*Primary Examiner*—Robert S. Macon

*Attorney, Agent, or Firm*—Charles E. Brown

[57] ABSTRACT

In a contacts closed position of a circuit breaker, a main body portion of a contact arm engages a main contact. Upon movement of the contacts towards an open position, an end portion of the contact arm moves into engagement with a tubular arcing electrode before the main body portion disengages from the main contact. Subsequently, the end portion disengages from the arcing electrode so that an arc is drawn therebetween, and the arcing current flows through a field coil creating a magnetic field which causes the arc to rotate and become extinguished. In the contacts open position of the circuit breaker, the end portion lies along the axis of the field coil. In an alternative construction, the end portion of the contact arm engages the arcing electrode when the contacts are in their closed position, and remains in such engagement for some time after the main body portion has disengaged from the main contact.

18 Claims, 16 Drawing Figures

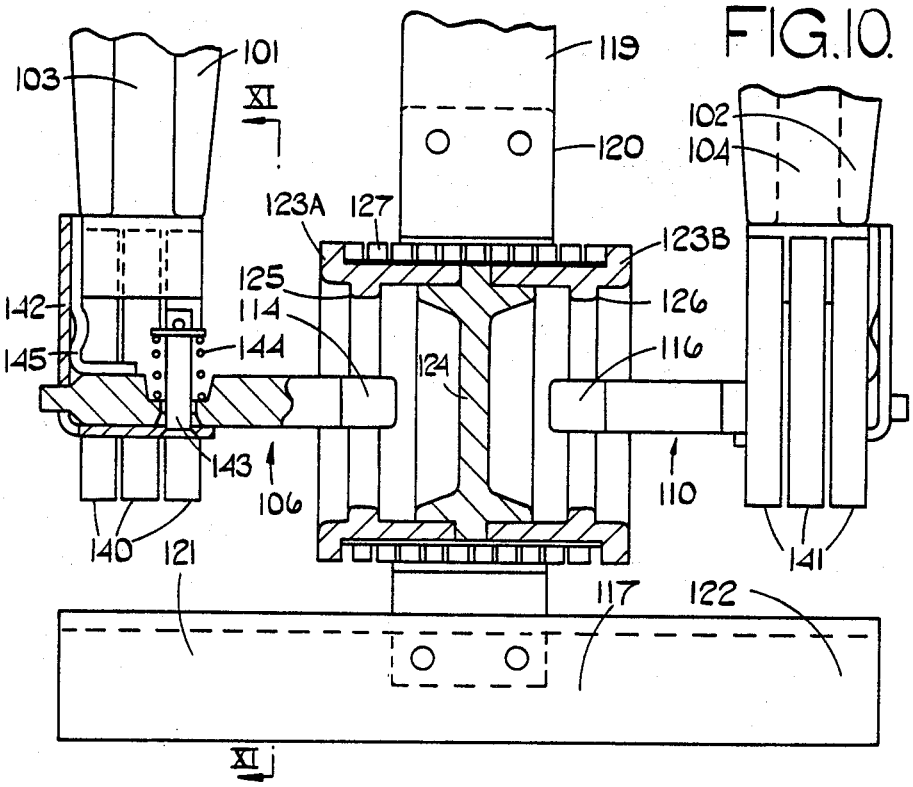
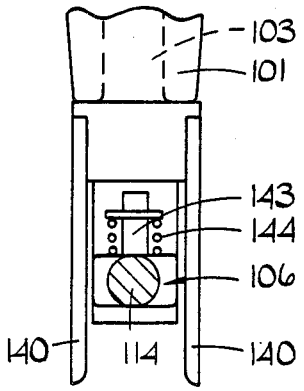
FIG.11.
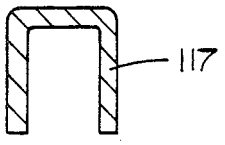

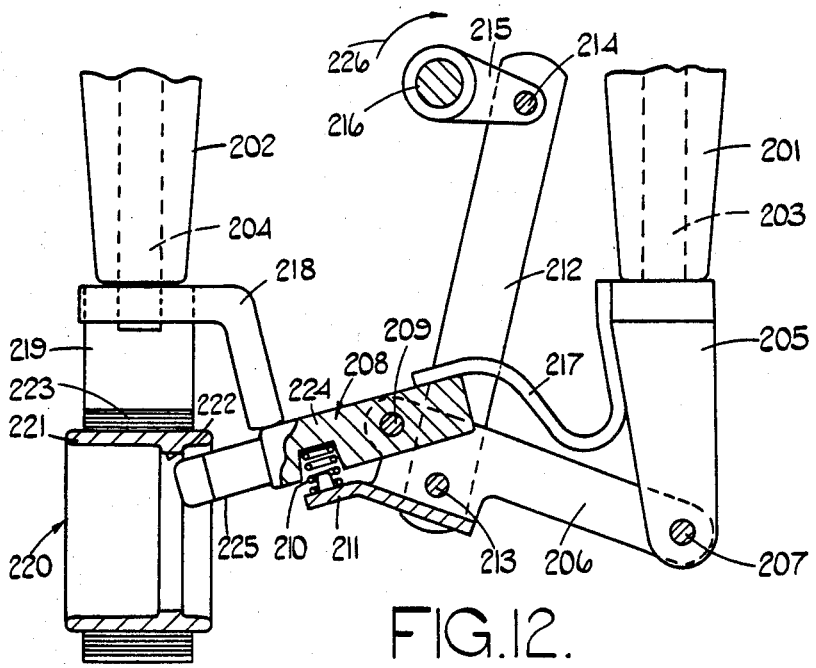
FIG.12.
FIG.13.
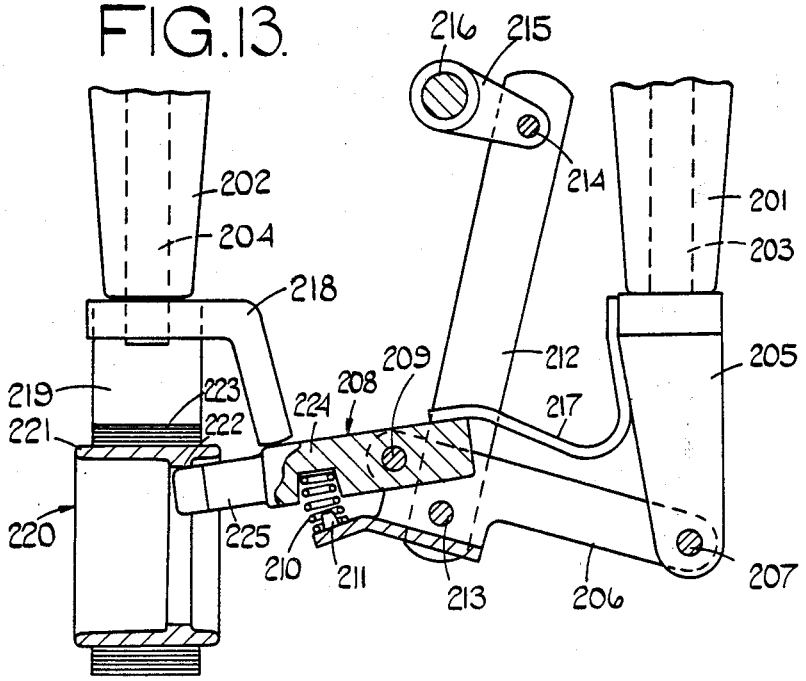

ELECTRICAL SWITCHGEAR

This invention relates to electrical switchgear, the term "switchgear" being used to embrace circuit breakers and other electrical switches.

In some known circuit breakers an arc rotation technique is employed to extinguish the arc drawn between contacts on opening the circuit breaker, and the arc current is caused to pass through a field coil to generate a magnetic field which makes the arc rotate and become extinguished. This technique is particularly useful in circuit breakers which utilize the highly insulating gas sulphur hexafluoride.

It is also well known to employ double break construction in switchgear by which a current is interrupted by two breaks in series instead of a single break. Double break construction is recognised as possessing advantages over single break construction particularly with regard to security of interruption but has the disadvantage that there are twice as many arcs to extinguish as in single break construction.

If an arc rotation technique is combined with a double break construction one is faced with the problem of either having to employ double the number of field coils or finding some way of sharing field coils without introducing the danger of "tracking" across the shared structure taking place. It has to be borne in mind that insulating surfaces in circuit breakers may become contaminated in time for example because of the presence of metal vapours in the arcs.

It is also a well known technique to provide an arcing contact to which an arc created on opening main or intermediate contacts transfers itself as one of the main or intermediate contacts moves near to the arcing contact. Since this technique relies on the arc behaving in a predetermined manner, the transfer of the arc must to some extent at least be regarded as not entirely certain.

It is an object of the present invention to obviate or mitigate this disadvantage.

According to the present invention, there is provided electrical switchgear comprising a contact set having first and second contact means relatively movable between a closed position in which they are mutually engaged and an open position in which they are mutually separated, a tubular arcing electrode to which the first contact means is arranged to arc during movement of the contacts from their closed position to their open position, and a field coil connected to the arcing electrode and disposed substantially co-axially therewith, the arcing current flowing through the field coil to create a magnetic field which causes the arc to rotate and become extinguished, the first contact means having a part which is arranged to engage the arcing electrode before and for some time after the first and second contact means disengage and which is arranged to move to a position substantially on the axis of the arcing electrode when the contacts move to their open position.

The said part of the first contact means can be engaged with the arcing electrode when the contacts are in their closed position. Alternatively, the said part of the first contact means can be spaced from the arcing electrode when the contacts are in their closed position and arranged to move into engagement with the arcing electrode during initial movement of the contacts towards their open position.

Embodiments of the present invention will now be described, by way of example, with reference to the accompanying drawings, in which:

FIGS. 9 and 10 are similar views to FIG. 8, but showing the contacts respectively partially open and fully open;

FIG. 11 is a section on the line XI—XI in FIG. 10;

FIG. 12 is a schematic side view of a third embodiment of electrical switchgear according to the present invention in the form of a single-break circuit breaker, showing contacts of the switchgear in a closed position;

FIGS. 13 and 14 are similar views to FIG. 12, but respectively showing the contacts partially open and fully open;

Figure 1:
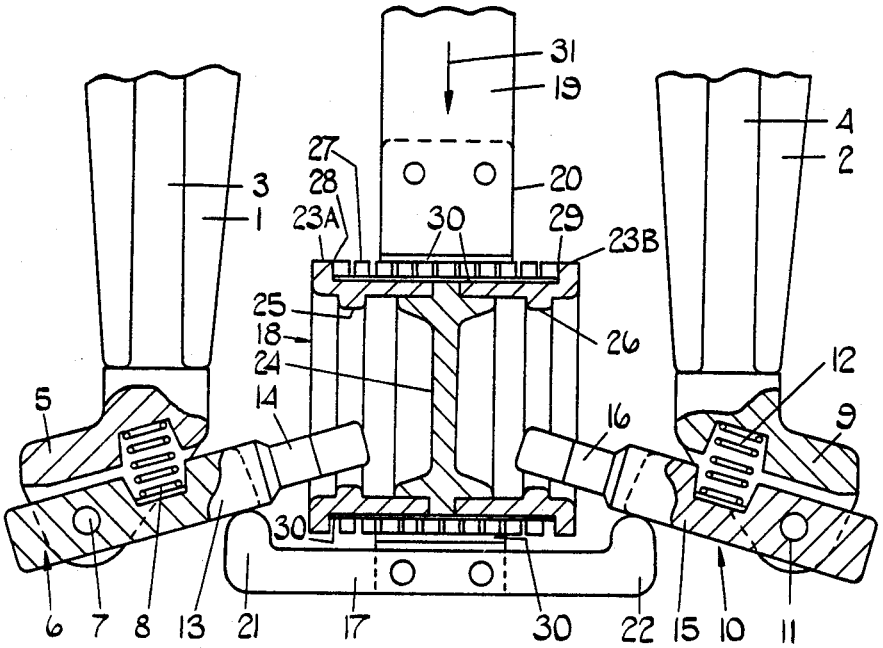
FIG. 1 is a schematic side view of a first embodiment of electrical switchgear according to the present invention in the form of a double-break circuit breaker, showing contacts of the switchgear in a closed position.

Referring first to FIGS. 1 to 6, the contacts and associated parts of a circuit breaker employing sulphur hexafluoride as an insulating gas are shown. The circuit breaker comprises a pair of electrically insulating terminal bushings 1 and 2 through which respective conductors 3 and 4 pass. A mounting 5 is provided at one end of the conductor 3 and pivotally supports a contact arm 6 by means of a pivot pin 7, a helical contact spring 8 in compression being provided to act between the mounting 5 and the contact arm 6. A similar assembly of a mounting 9, a contact arm 10, a pivot pin 11 and a spring 12 are provided at the end of the conductor 4. The contact arm 6 is composed of a main body portion 13 of rectangular cross-section and an end portion 14 of lesser and circular cross-section. The contact arm 10 is similarly composed of a main body portion 15 and an end portion 15. The end portions 14 and 16 can be provided with arc-resistant material.

The circuit breaker also comprises a main contact bar 17 and a field coil assembly 18 which are mounted on an end of a reciprocable insulating shaft 19 by means of a support member 20. The main contact bar 17 has ends 21 and 22 which engage the main body portions of the contact arms 6 and 10 respectively when the circuit breaker is in a closed position, as shown in FIG. 1. The springs 8 and 12 act to urge their associated contact arms into engagement with the main contact bar 17, and a current path thus exists from the conductor 3 to the conductor 4 by way of the mounting 5, the contact arm 6, the main contact bar 17, the contact arm 10 and the mounting 9.

The field coil assembly 18 comprises a pair of co-axially disposed tubular arcing electrodes 23A and 23B which are separated by a central, transversely extending insulating barrier 24. The electrodes 23A and 23B are provided with respective internal annular projections or arc runners 25 and 26, which can be surfaced with arc-resistant material. A helical field coil 27 surrounds the external surfaces of the arcing electrodes 23A and 23B. One end of the coil 27 is connected to electrode 23A at a point 28, the other end of the coil being connected to electrode 23B at a point 29. Otherwise, the coil 27 is electrically insulated from the arcing electrodes by means of insulation 30. In the closed position of the circuit breaker, the end portions 14 and 16 of the contact arms 6 and 10 lie within the field coil assembly 18, and are adjacent to but spaced from the arc runners 25 and 26 of the electrodes 23A and 23B, respectively.

Figure 2:
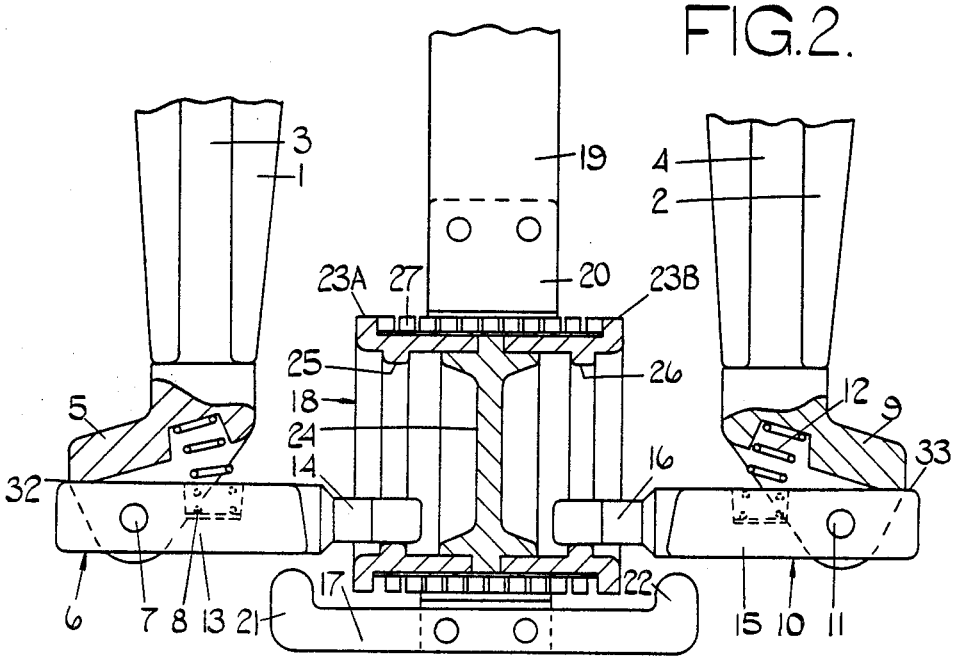
FIGS. 2 and 3 are similar views to FIG. 1, but showing the contacts respectively partially open and fully open.

In order to open the contacts of the circuit breaker, the shaft 19 is moved in the direction of the arrow 31 by an operating mechanism (not shown), the field coil assembly 18 and main contact bar 17 moving with the shaft since they are carried by it. As the shaft 19 moves in the direction of the arrow 31, the contact arms 6 and 10 pivot under the action of their respective springs 8 and 12 to follow the motion of the main contact bar 17. On further movement of the shaft 19, the end portions 14 and 16 of the contact arms come into contact with the arc runners 25 and 26 respectively, and the main body portions 13 and 15 disengage from the main contact bar 17. Ignoring any minor arcing at the main contact bar 17, the current path from conductor 3 to conductor 4 is now by way of the end portion 14 of contact arm 6, the arcing electrode 23A, the field coil 27, the arcing electrode 23B and the end portion 16 of contact arm 10. Pivotal movement of the arms 6 and 10 is limited by parts 32 and 33 of the mountings 5 and 9 which act as stops, and at their limits of movement the arms lie along a common axis. At this instant, the parts are disposed as shown in FIG. 2.

Figure 3:
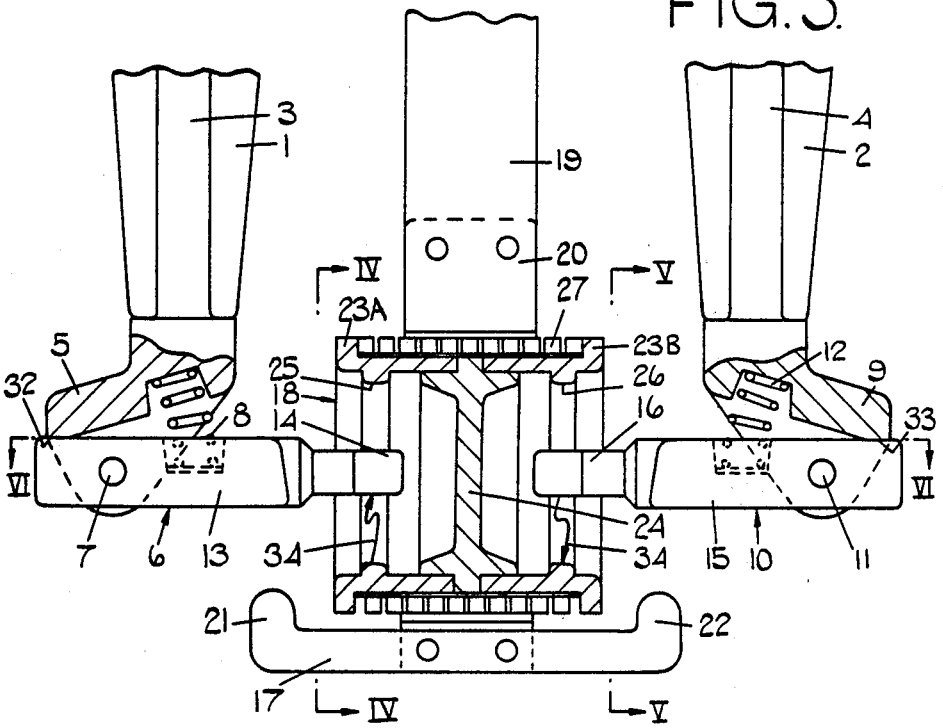
Figure 4:
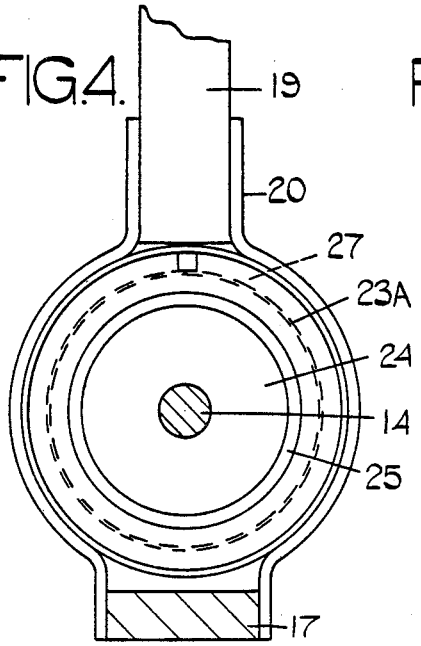
FIG. 4 is a section along the line IV—IV in FIG. 3.
Figure 5:
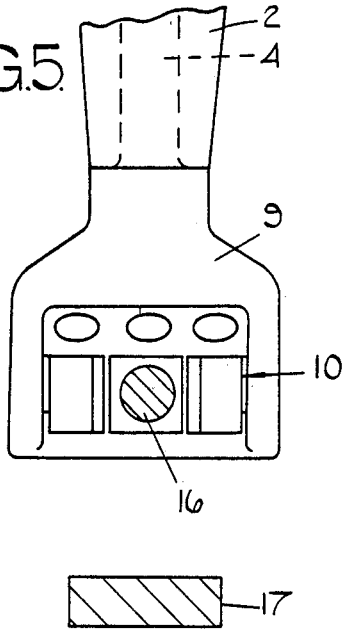
FIG. 5 is a section along the line V—V in FIG. 3.
Figure 6:
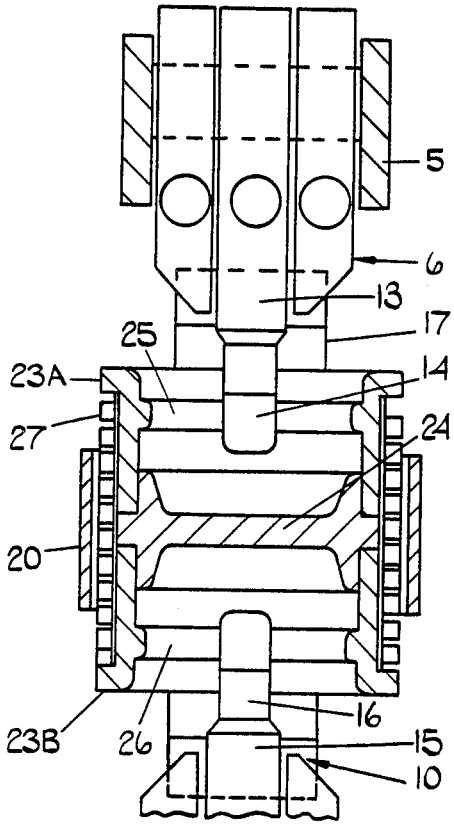
FIG. 6 is a section along the line VI—VI in FIG. 3.

On continued movement of the shaft 19, the arc runners 25 and 26 move out of contact with the contact arms 6 and 10, and an arc 34 is drawn radially between the end of each contact arm and the associated arc runner. Movement of the shaft 19 ceases when the axis of the field coil assembly 18 in alignment with the common axis of the contact arms, as shown in FIG. 3. The current path from conductor 3 to conductor 4 is now by way of contact arm 6, the arc between end portion 14 and arc runner 25, the field coil 27, the arc between arc runner 26 and end portion 16, and contact arm 10. The magnetic field generated by the current flowing in the coil 27 causes the axis to rotate and become extinguished.

Figure 7:
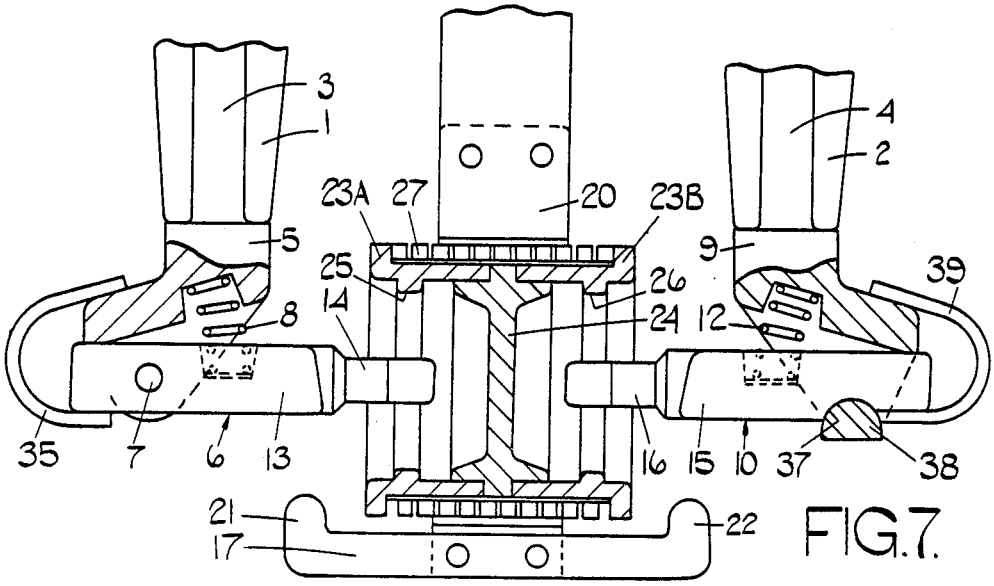
FIG. 7 is a similar view to FIG. 1 showing a modified form of electrical switchgear.

In the above construction, the connection between the contact arms and their mountings are shown as simple pin joints. In practice, however, a flexible conductive strap 35 can be added as shown in the left-hand part of FIG. 7 for the passage of most of the load current therethrough. In the right-hand part of FIG. 7, an aternative to the pin joint in the form of a stirrup-type mounting is shown. In this mounting, the main body portion of the contact arm has a recess 37 therein which locates over a projection 38 on the lower part of the mounting, enabling the contact arm to rock about the projection 38. A flexible conductive strap 39 connects the contact arm to the mounting for the passage of most of the load current therethrough.

Figure 8:
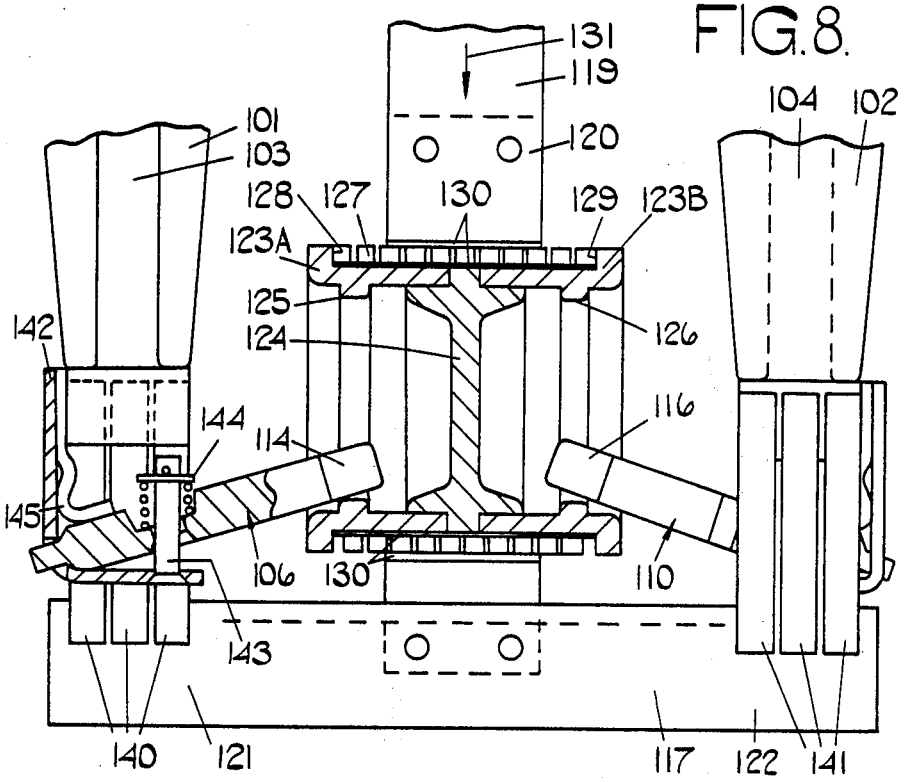
FIG. 8 is a schematic side view of a second embodiment of electrical switchgear according to the present invention in the form of a double-break circuit breaker, showing contacts of the switchgear in a closed position.

A second embodiment of a circuit breaker according to the present invention is shown in FIGS. 8 to 11, and is generally similar to the embodiment already described with reference to FIGS. 1 to 6. Accordingly, similar parts are denoted by the same reference numerals, but with 100 added. In this embodiment, however, the conductors 103 and 104 are connected to respective sets 140 and 141 of main contact fingers which engage the ends of the main contact bar 117 when the circuit breaker is in its closed position, as shown in FIG. 8. The contact arm 106 is mounted for angular movement by a respective yoke member 142 and a mounting pin 143 passing through a shaped recess in the contact arm, and a spring 144 provided about the pin 143 urges the contact arm towards the position shown in FIG. 10. A flexible conductive strap 145 connects the contact arm 106 to the conductor 103 for the passage of most of the load current therethrough. The contact arm 110 is similarly provided with a yoke member, mounting pin, spring and flexible strap.

Whereas in the construction of FIGS. 1 to 6 the contact arms are spaced from the respective arc runners when the circuit breaker is in its close position, in this embodiment the end portions 114 and 116 of the contact arms 106 and 110 actually engage the arc runners 125 and 126 respectively in the contacts closed position. However, since the main contact bar 117 is in parallel with the field coil 127, little current passes through the coil 127 in the closed position because it presents a path of higher impedance than the contact bar 117.

Figure 9:
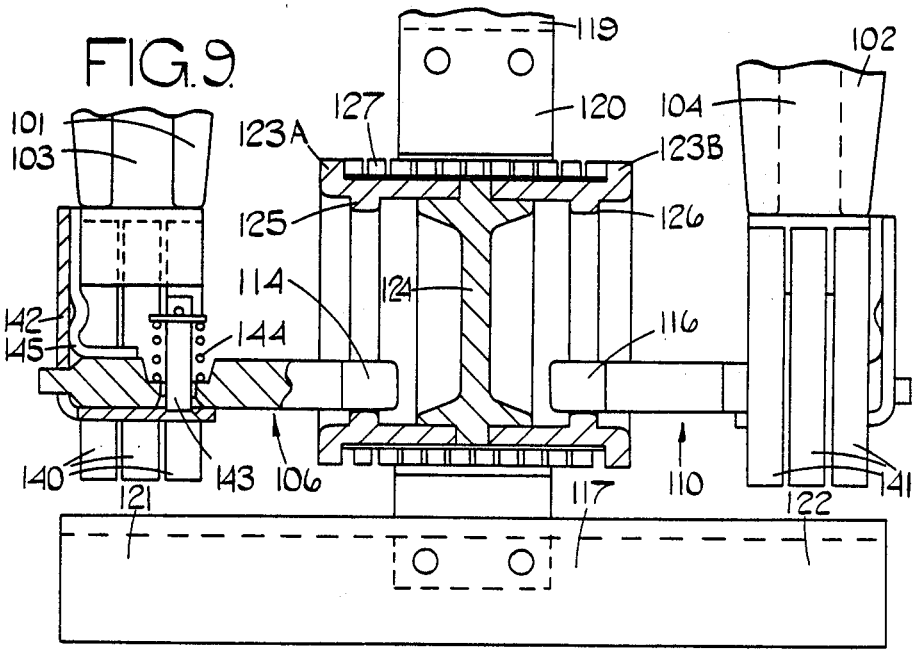

The circuit breaker is opened by moving the shaft 119 in the direction of arrow 131. After the ends of the contact bar 117 have disengaged from the contact fingers 140 and 141 the drawing and extinction of the arcs proceeds as described above with reference to FIGS. 1 to 3. FIGS. 8, 9 and 10 illustrate various stages during this operation, and correspond respectively to the stages shown in FIGS. 1, 2 and 3.

Figure 14:
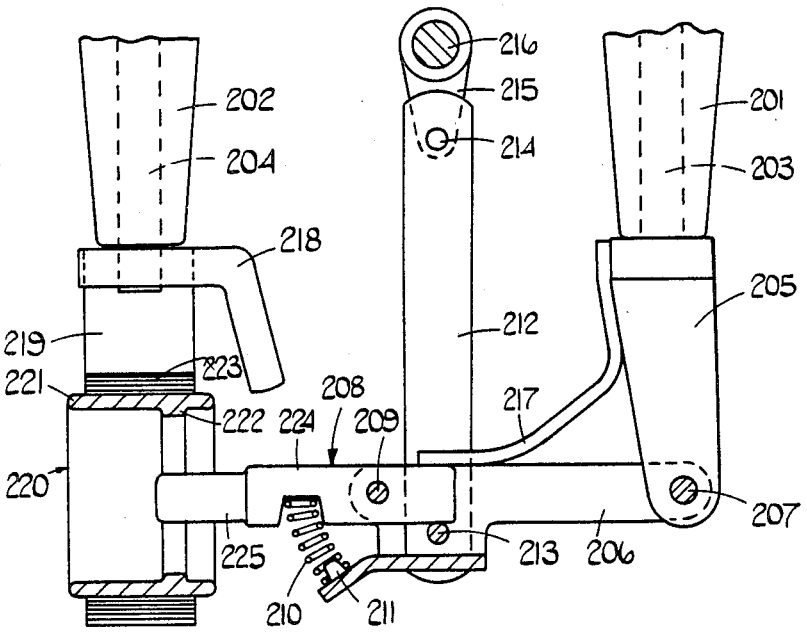

A third embodiment of the invention, in the form of a single-break circuit breaker employing sulphur hexafluoride as an insulating gas, is shown in FIGS. 12 to 14. The circuit breaker comprises a pair of insulating terminal bushings 201 and 202 through which respective conductors 203 and 204 pass. A mounting 205 is provided at an end of the conductor 203 and pivotally supports one end of an electrically conductive link member 206 on a pivot pin 207. The other end of the link member 206 pivotally mounts a contact arm 208 on a pivot pin 209, and a compression spring 210 is interposed between the contact arm 208 and an abutment 211 on the link member 206 so as to urge the contact arm anticlockwise as viewed in FIGS. 12 to 14. An electrically insulating link 212 has one end thereof pivotally connected to the link member 206 by way of a pivot pin 213, the other end of the link 212 being pivotally connected by means of a pivot pin 214 to a crank member 215 which is rotatable with an operating shaft 216. A flexible electrically conductive strap 217 connects the link member 206 to the conductor 203 for the passage of most of the load current therethrough.

An end of the conductor 204 supports a main contact 218 and an electrically conductive support member 219 on which a field coil assembly 220 is carried. The field coil assembly 220 comprises a tubular arcing electrode 221 having an internal annular projection or arc runner 222 which can be surfaced with arc-resistant material, and a field coil 223 which is connected between the arcing electrode 221 and the support member 219. The field coil 223 can be a self-supporting spirally-wound coil having its inner end connected to the arcing electrode and its outer end connected to the support member. Alternatively, the field coil can be helically wound about the external surface of the arcing electrode, in which case a separate support for the arcing electrode will be required.

The contact arm 208 comprises a main body portion 224 of rectangular cross-section and an end portion 225 of reduced circular cross-section. The tip of the end portion 225 can be surfaced with arc-resistant material. In a contacts closed position of the circuit breaker (shown in FIG. 12), the main body portion 224 is urged by the spring 210 into engagement with the main contact 218 and the end portion 225 is held spaced from the arc runner 222.

The circuit breaker is opened by rotation of the operating shaft 216 in the direction of arrow 226, which causes the link member 206 to move angularly about the pivot point 207 and the contact arm 208 to rock on the tip of the main contact 218 until the end portion 225 thereof comes into contact with the arc runner 222. Further rotation of the shaft 226 causes the contact arm 208 to disengage from the main contact 218 whilst still maintaining contact with the arc runner 222, as illustrated in FIG. 13. On continued rotation of the shaft 216, the end portion 225 of the contact arm 208 maintaining contact with the arc runner 222 until the main body portion 224 pivoting about the pin 209 engages the pivot pin 213, which acts as a stop. Thereafter, the end portion 225 moves away from the arc runner 222 until, at the contacts open position shown in FIG. 14, the contact arm 208 lies on the central axis of the arcing tube electrode 221.

In the contacts closed position of the circuit breaker, the current path is by way of conductor 203, contact arm 208, the main contact 218 and the conductor 204. However, as the circuit breaker is opened the field coil assembly 220 is first connected in parallel with the contacts closed current path, and thereafter engagement of the contact arm 208 with the main contact 218 is broken with perhaps some minor arcing. Upon disengagement of the contact arm 208 from the arcing electrode 221, the connection to the field coil assembly 220 is opened and an arc is drawn from the end portion 225 of the contact arm to the arc runner 222, the arcing current passing through the field coil 223. When the contacts are in their fully open position, the arc lies radially within the arcing electrode 221 and the magnetic field from the the field coil 223 causes the arc to rotate and become extinguished.

Figure 15:
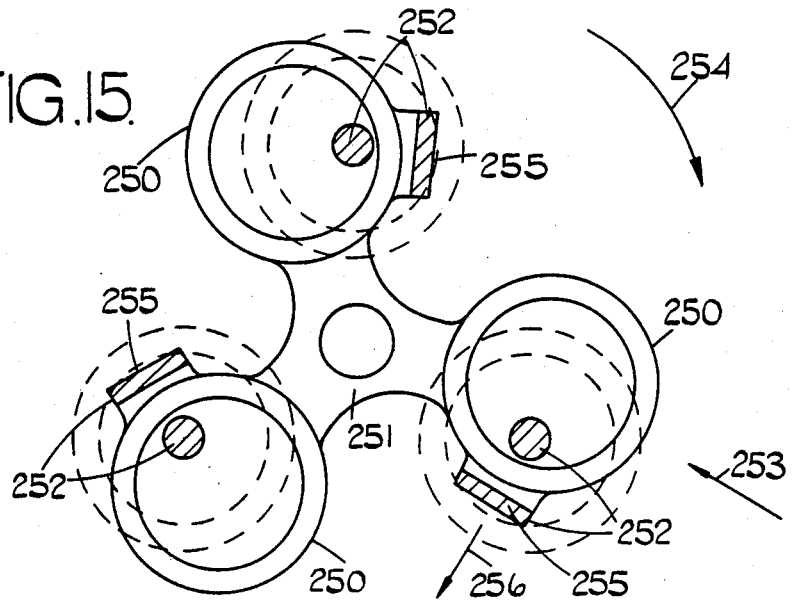
FIG. 15 is a schematic view of a fourth embodiment of electrical switchgear according to the present invention, suitable for three-phase operation.

FIG. 15 illustrates diagrammatically a three phase circuit breaker in which the rectilinear movement of the coil assembly of the circuit breaker of FIGS. 1 to 6 is replaced by an arcuate movement. Three coil assemblies 250 are carried on a rotatably mounted insulating spider 251 and each coil assembly is associated with a respective contact assembly 251 such that the view along the direction of the arrow 253 corresponds generally to FIG. 1. The spider 251 is rotated in the direction of arrow 254 to open the contacts, the contacts open position of the coil assemblies being shown in dotted lines and the contacts closed position in solid outline. Reference numeral 255 denotes the main contact bars, and arrow 256 shows the load direction of one of the contact springs.

Figure 16:
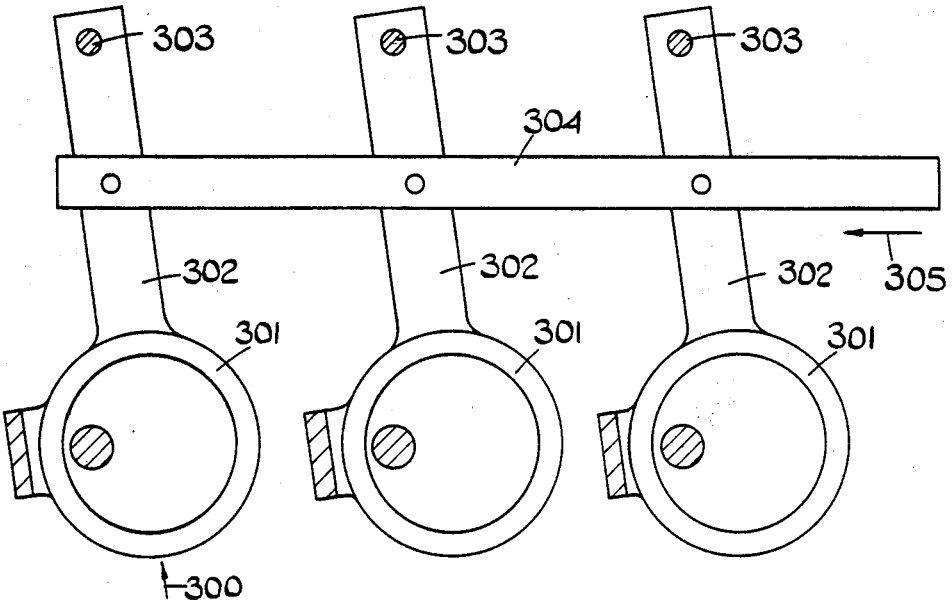
FIG. 16 is a schematic view of a fifth embodiment of electrical switchgear according to the present invention, also suitable for three-phase operation.

FIG. 16 illustrates diagrammatically another three phase circuit breaker in which a view along the arrow 300 corresponds generally to FIG. 1. In FIG. 16, coil assemblies 301 are carried on respective insulating links 302 pivotally mounted on fixed pivots 303. An operating link 304 pivotally connected to the insulating links 302 is movable in the direction of the arrow 305 to open the circuit breaker (the contacts open position of one coil assembly being shown in broken outline).

All the illustrated arrangements possess the advantage that during the opening of the contacts, current is cummutated positively to energise the field coil so that further movement will draw the radial arc or arcs in an excellent position for subsequent rotation and extinction. The main contact faces are kept well away from the arcing contacts so that contamination from the products of the rotating arc will be reduced. The arcing contacts need be large enough only to deal with the short duration of current interruption while the main contacts can be of heavier construction to carry the normal continuous rated current. As an alternative to the illustrated arrangements multiple main contact fingers can be used where the normal rated current is high.

The double break arrangements have the advantage of using only one field coil per double break while keeping low the danger of "tracking" across the shared structure, since there is no continuous solid insulating material between the contacts when the circuit breaker is open. The principal insulating surfaces are advantageously arranged between live parts and earth (as opposed to across the poles) and are kept well away from the direct arcing zone. A solid insulating barrier is provided between the two arcing zones positively to prevent the arc being transferred directly across the two contact arms. It is to be noted, however, that this insulation material has to have good "puncture" strength only and, in the vicinity of the arcs, does not need to have electrical strength over its surfaces within the arcing electrodes. The insulating barrier provides support for the pair of arcing electrodes, while separating them electrically to permit the flow of current through the field coil. The outer cylindrical surface of this barrier is therefore the only part which is stressed along its surface. This surface is well protected from the effects of arcing and is subject only to the voltage drop across the coil. Contamination of the other surfaces will not significantly, if at all, affect the performance.

Although only a single phase is shown in the embodiments of FIGS. 1 to 14, it is to be understood that multiphase arrangements can be made by an appropriate replication of parts.

The constructions shown in FIGS. 1 to 11 and FIGS. 15 and 16 also form the subject matter of our co-pending U.K. patent application No. (our reference Case 3), and the embodiments of FIGS. 8 to 14 form part of the subject matter of our co-pending U.K. patent application No. 7,939,949.

I claim:

1. Electrical switchgear comprising a contact set having first contact means and second contact means, and moving means operative to move said contact set between a closed position in which said first and second contact means are mutually engaged and an open position in which said first and second contact means are mutually separated, a tubular arcing electrode to which said first contact means forms an arc during movement of said contact set from said closed position to said open position, and a field coil connected to said tubular arcing electrode, said tubular arcing electrode and said field coil having respective axes which are substantially co-incident, a current produced by said arc flowing through said field coil to create a magnetic field which causes said arc to rotate and become extinguished, said first contact means having a part which engages said tubular arcing electrode before and for some time after said first and second contact means disengage and which moves to a position substantially on said axis of said tubular arcing electrode when said contact set moves to said open position, said first contact means having mounting means for said movement to be transversely of the axis of said field coil with said movement providing a lever action between said part and said second contact means for breaking any welds that may be formed between said contact means.

2. The electrical switchgear according to claim 1, wherein said part of said first contact means is engaged with said tubular arcing electrode when said contact set is in said closed position.

3. The electrical switchgear according to claim 1, wherein said part of said first contact means is spaced from said tubular arcing electrode when said contact set is in said closed position and moves into engagement with said tubular electrode during initial movement of said contact set towards said open position.

4. The electrical switchgear according to claim 1, wherein said first contact means includes a contact arm which is angularly movable about an axis transverse to said axis of said field coil.

5. The electrical switchgear according to claim 4, wherein said contact arm has a main body portion which engages said second contact means when said contact set is in said closed position, and an end portion which constitutes said part of said first contact means.

6. The electrical switchgear as according to claim 4, further comprising a link member on which said contact arm is pivotally mounted and which is angularly movable about a fixed pivot axis, and an operating mechanism for opening and closing said contact set operatively coupled to said link member.

7. The electrical switchgear according to claim 4, wherein said part of said first contact means is constituted by said contact arm, and said first contact means also includes contact fingers which engage said second contact means when said contact set is in said closed position.

8. The electrical switchgear according to claim 4, wherein said contact arm has a spring-loaded pivotal or rocking mounting.

9. The electrical switchgear according to claim 1, wherein said tubular arcing electrode is generally cylindrical.

10. The electrical switchgear according to claim 9, wherein said tubular arcing electrode is of circular cross-section.

11. The electrical switchgear according to claim 1, comprising two contact sets each having respective first and second contact means and a respective associated tubular arcing electrode, each said tubular arcing electrode being connected to a respective end of a common field coil and said contact means of said two contact sets being electrically connected together.

12. The electrical switchgear according to claim 1, wherein said field coil is electrically connected to said second contact means.

13. The electrical switchgear according to claim 1, further comprising a common support on which said field coil, said tubular arcing electrode and said second contact means are mounted, said common support being movable by said moving means relative to said first contact means in a direction transverse to said axis of said field coil.

14. The electrical switchgear according to claim 1, comprising a plurality of contact sets each having respective first and second contact means and a respective associated field coil and tubular arcing electrode, said second contact means, said field coils and said tubular arcing electrodes of all said contact sets being movable in unison relative to said first contact means.

15. The electrical switchgear according to claim 14, further comprising a common support on which said second contact means, said field coils and said tubular arcing electrodes are mounted and which is angularly movable about a rotation axis, said first contact means of said contact sets being angularly spaced apart around said rotation axis.

16. The electrical switchgear according to claim 14, further comprising a plurality of supports each of which mounts said second contact means of a respective one of said contact sets and said respective field coil and tubular arcing electrode, said supports being angularly movable about respective fixed rotation axes, and an operating link which interconnects said supports and which is movable to effect angular movement of said supports about said respective rotation axes in unison.

17. The electrical switchgear according to claim 1, in the form of a circuit breaker.

18. The electrical switchgear according to claim 1, wherein sulphur hexafluoride is employed as an insulating gas.

* * * * *